United States Patent [19]

Brooks

[11] Patent Number: 4,643,744

[45] Date of Patent: Feb. 17, 1987

[54] APPARATUS FOR IONIZING AIR

[75] Inventor: Douglas M. Brooks, Corby, England

[73] Assignee: Triactor Holdings Limited, Castletown, England

[21] Appl. No.: 700,977

[22] Filed: Feb. 12, 1985

[30] Foreign Application Priority Data

Feb. 13, 1984 [GB] United Kingdom ..... 8403735

[51] Int. Cl.[4] ..... B03C 9/00; H05F 3/00; F23L 1/00; B05B 5/00

[52] U.S. Cl. ..... 55/107; 55/103; 261/17; 261/22; 261/152; 261/DIG. 3; 361/226; 361/227; 110/301; 239/3; 239/690

[58] Field of Search ..... 55/94, 257 HE, 93, 89, 55/122, 10, 107, 124, 126, 135, 146, 267, 268, 269, 222, 257 R, 360, 103; 261/152, 17, 22, DIG. 3; 361/225, 226, 227, 228; 110/301; 431/2; 239/3, 690

[56] References Cited

U.S. PATENT DOCUMENTS

| | | | |
|---|---|---|---|
| 808,897 | 1/1906 | Carrier | 261/DIG. 3 |
| 1,471,112 | 9/1923 | Ellis | 55/222 |
| 1,533,859 | 4/1925 | Hodge | 55/222 X |
| 1,620,826 | 3/1927 | Mitchell | 261/22 X |
| 2,207,576 | 7/1940 | Brown | 55/10 |
| 2,949,168 | 8/1960 | Peterson | 55/124 X |
| 3,331,192 | 7/1967 | Peterson | 55/146 X |
| 3,473,298 | 10/1969 | Berman | 55/257 HE |
| 3,864,485 | 2/1975 | Horsley et al. | 55/94 X |
| 4,039,307 | 8/1977 | Bondor | 55/257 R X |
| 4,191,541 | 3/1980 | Jenkins | 55/93 X |
| 4,193,774 | 3/1980 | Pilot | 55/89 X |

FOREIGN PATENT DOCUMENTS

| | | | |
|---|---|---|---|
| 491332 | 8/1938 | United Kingdom . | |
| 2014469 | 8/1979 | United Kingdom . | |
| 656645 | 4/1979 | U.S.S.R. | 55/222 |

OTHER PUBLICATIONS

"*Carrier Mobility Spectra of Liquids Electrified by Bubbling*" S. Chapman, Physical Review, vol. 54, Oct. 1, 1938, pp. 520–527.

"*The Basic Mechanisms of Static Electrification*" L. Loeb, *Science*, vol. 102, 12–7–1945, No. 2658.

*Primary Examiner*—S. Leon Bashore
*Assistant Examiner*—Thomas M. Lithgow
*Attorney, Agent, or Firm*—Solon B. Kemon

[57] ABSTRACT

Apparatus for ionizing air, for example for feeding to a boiler to act as a catalyst, comprises a closed container (15) which is divided into two chambers (17, 18). Water is fed under pressure to atomizing jets (21,22) which produce a mist inside each chamber. Air is fed by a pump (28) into the first chamber and passes upwards through the mist in that chamber, through an aperture (20) near the top of a partition wall (19) and downwards through the mist in the second chamber. The thus-ionized air leaves the second chamber via an outlet pipe (30) and passes through a demoisturizing coil (31). The water for feeding to the jets is contained in a reservoir (2) at the bottom of a casing (1) in which the container is mounted.

6 Claims, 2 Drawing Figures

APPARATUS FOR IONIZING AIR

Figure 1:
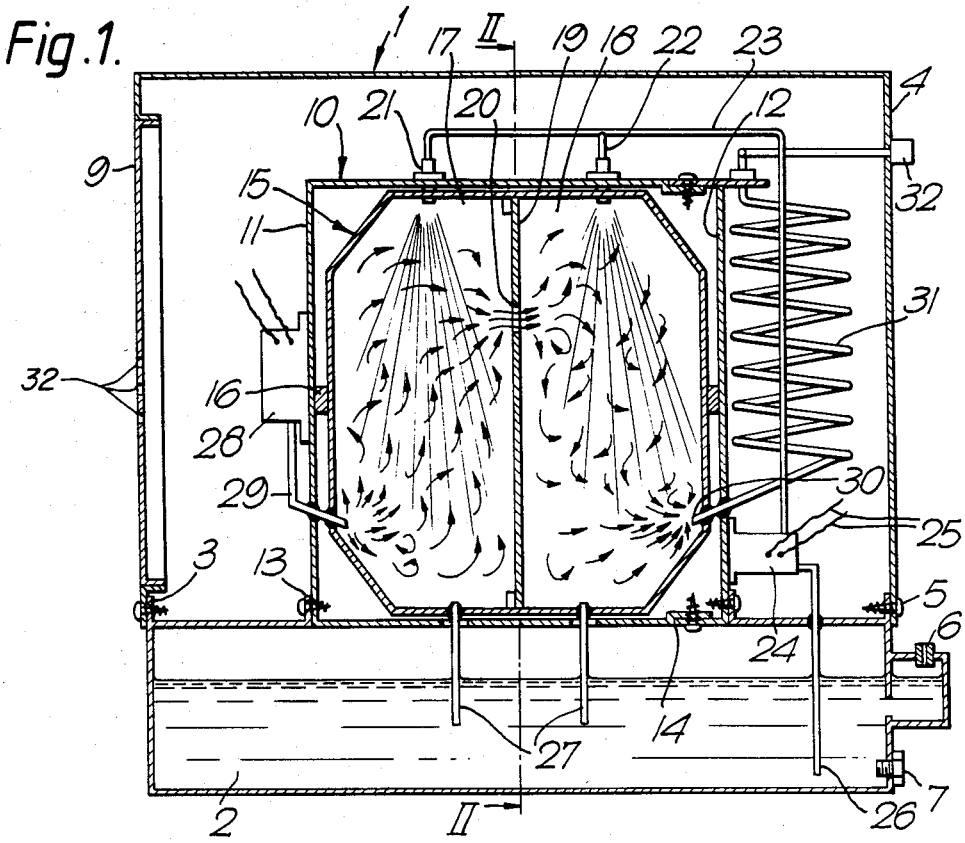

This invention relates to apparatus for ionising air. The ionised air generated by the apparatus may, for example, be fed to a boiler to increase the efficiency of combustion of the fuel therein.

Apparatus has previously been proposed (see British patent Specification No. 2,014,469) in which air is ionised by feeding it under pressure into a perforated manifold at the bottom of a tank containing water, so that the air bubbles upwards through the water. The ionised air is then demoisturised before it is extracted from the tank, and the dry ionised air is added to the natural air supply to the boiler. Considerable savings in fuel consumption have been effected by the use of such apparatus.

However, such apparatus has a number of disadvantages. Firstly, the water level in the tank must be maintained substantially constant, and regular inspection of the apparatus is therefore essential.

Secondly, the quantity of air consumed by the boiler varies considerably from time to time, depending upon the boiler loading. The greater the quantity of air flowing into the boiler, the greater the depression at the outlet of the ionising apparatus. The size of the air bubbles passing through the water is dependent upon both the manifold inlet pressure and the outlet depression. Hence, the bubble size varies in dependence upon the boiler loading. This affects the efficiency of the ionisation process, and it not readily controllable.

Thirdly, for effective operation, the known apparatus must remain substantially level, so that the water level within the tank maintains the correct attitude relative to the inlet manifold and the ionised air outlet. The apparatus could not, therefore, be used satisfactorily on board ship, where the rolling and pitching of the ship would cause considerable changes in the attitude of the apparatus relative to the water level, and would also cause the water to swill around within the tank. To prevent this, it would be necessary to mount the tank on gimbals.

An object of the present invention is to provide an air ionisation apparatus which alleviates the above problems.

According to the invention, apparatus for ionising air comprises a closed container; means to produce a water mist within the container; means to cause the air to pass through the water mist to ionise the air; and outlet means through which the thus-ionised air is extracted from the container.

Preferably the means to produce a water mist comprises at least one atomising jet. The container is preferably divided into first and second chambers through which the air passes in turn, each chamber including at least one atomising jet. Demoisturising means is preferably provided at the outlet means to dry the ionised air. The container preferably communicates the a reservoir from which water is pumped to the atomising jets and into which the water from the jets drains out of the container.

Figure 2:
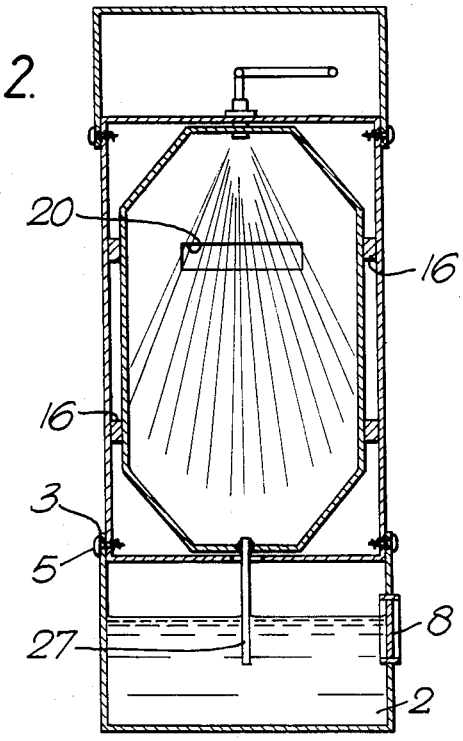

An embodiment of the invention will now be described, by way of example, with reference to the accompanying drawing, in which:

FIG. 1 shows a vertical section through an ionising apparatus in accordance with the invention; and FIG. 2 is a vertical section on a line II—II of FIG. 1.

Referring to the drawing, an air ionisation apparatus includes an outer casing 1, which comprises a reservoir

2 which holds demineralised water, the upper edge of the reservoir having an upstanding flange 3 which extends around its periphery, the casing 1 further comprising a cover 4 which is secured to the flange 3 by screws 5. The reservoir 2 has a ventilated filler plug 6 which is removable for topping-up the water level, and a threaded drain plug 7. An inspection glass 8 is provided in the side of the reservoir for viewing the water level therein. One side of the cover includes a door 9 for providing access to electrical control equipment (not shown), housed within the casing. Air is admitted to the casing 1 via apertures 33 in the wall of the cover 4.

An inner casing 10 comprises a first part 11, which is formed as an open-ended box, and a cover 12 which is screwed to the first part to close the box. The bottom of the casing 10 is secured and sealed to an upstanding flange 13 which is formed around a rectangular aperture 14 in the top of the reservoir 2.

A completely enclosed sealed inner tank 15, made of an insulating antistatic material such as acrylic, plastics or glass sheet, or made of copper and bonded to earth, is mounted within the casing 10 and is located therein by antistatic spacing blocks 16. The tank 15 is divided into two chambers 17 and 18 by a vertical plate 19 having a horizontal slot 20 therethrough.

Water inlet jets 21 and 22 pass through the top of the casing 10 and the top of a respective chamber 17 and 18. The jets are connected, via pipework 23, to a water pump 24, which is mounted on the outside of the cover 12 of the casing 10. The pump is connected to the electrical control equipment via lines 25. Water is pumped from the reservoir 2 via a well-pipe 26, and is forced by the pump 24 through the jets 21 and 22, which atomise the water and form a mist within the chambers 17 and 18. The water drains out of the chambers and back into the reservoir via outlet pipes 27.

An air pump 28, also connected to the control equipment, is mounted on the outside of the casing 10 and pumps air through an inlet pipe 29, which enters the chamber 17 towards the bottom of that chamber. The air passes in a turbulent flow upwards through the water spray in the chamber 17, through the aperture 20 in the plate 19, and downwards through the spray in the chamber 18 to an air outlet pipe 30 near the bottom of that chamber. The outlet pipe, which is made of an insulating antistatic material such as mentioned above or of copper bonded to earth, is formed into a helix 31 which extends vertically upwards outside the casing 10 but within the casing 1. An outlet from the helix passes through the wall of the casing 1, and terminates in a snap-on connector 32.

The air passing through the water spray in each of the chambers is ionised thereby, so that discrete positive and negative ions are formed. The passage of the air through the aperture 20 into the chamber 18 reconcentrates the air, so that further ionisation by the spray jet 22 can be achieved, resulting in a more thorough overall ionisation process. The helix 31 acts as a demoisturiser, whereby water carried into the outlet 30 by the ionised air drains back into the chamber 18, so that the air passing out through the connector 32 is substantially dry. The wall of the helix becomes positively charged by contact with the water, and some negative ions carried by the air are therefore attracted towards the wall, carrying water droplets with them. This rids the air of much of the unwanted water. It does, however, have the disadvantage that some of the desired negative ionisation is lost.

The demineralised water may contain additives, such as ethylene glycol or a basic salt such as a platinum salt, for enhancing the production of ions in the air as it passes through the water.

Although an important and very advantageous use of the ionised air produced by the apparatus is, as mentioned above, improvement of the combustion efficiency of a boiler, the negatively-charged air could alternatively be used for many other purposes. For example, the air could be used in air-conditioning plant; in hazardous atmospheres, such as may occur in coalmines, to neutralise the possible effect of spurious positive charges which could cause explosions; to neutralise positive charges produced on fast-moving machinery, such as weaving looms; or to provide a negatively-charged atmosphere around an electrostatic spraying plant.

The air attains its negative ionisation due to its passage through the mist of water droplets. These droplets contain positive and negative ions which are created by mechanical agitation of the water at the spray jets 21 and 22. The negative ions tend to associate with the air passing through the mist, whilst the positive ions favor the liquid environment. The air carries negative ionisation away to the outlet 30, and the water becomes progressively more and more positively charged, and therefore, acidic. The water in the reservoir 2 must, therefore, be replaced at intervals. It will be seen that the negative ions must be removed rapidly from the container, before they have a chance to recombine with the positive ions. It is for the purpose of hindering the neutralization of the negative ions that the tank 15 is constructed of antistatic material, or is made of copper bonded to earth, and is supported by the antistatic spacing blocks 16.

Because the air in the apparatus of the present invention does not bubble up through a water bath as it does in the prior art apparatus, there is no need to maintain a constant water level. Provided there is sufficient water in the reservoir 2 for feeding the jets, the present apparatus will operate satisfactorily. Furthermore, because the ionising water comes from the jets there is no need to maintain the apparatus in a particular attitude. The operation of the atomising jets is not substantially influenced by the depression in the inner tank 15. The ionisation process is not adversely affected by sonic or ultrasonic vibrations which could affect the operation of the prior water bath apparatus.

I claim:

1. Ion-generation and delivery apparatus, comprising a closed container made of insulating antistatic material to define a charge-transferring region therein, the container having gas inlet means and gas outlet means; water-spraying means to produce, in said charge-transferring region of said container, a water mist which includes discrete negative and positive ions, said water-spraying means consisting of at least one atomizing jet and means to deliver water to said at least one atomizing jet, the insulating antistatic construction of the container being such as to limit recombination of said negative and positive ions within said charge-transferring region; means to cause gas to enter said container via said inlet means and to pass through said mist in said charge-transferring region, whereby negative ionisation is imparted to said gas by said water mist; and demoisturizer means made of insulating antistatic material connected to said gas outlet to permit delivery of the negatively ionised gas to a location at which said negative ionisation is to be used and for substantially drying the ionized gas.

2. Apparatus as claimed in claim 1, wherein said container includes a substantially vertical partition wall of insulating antistatic material to divide the container into first and second chambers through which, in turn, the gas passes; and wherein said water-spraying means further consists of one atmosing nozzle in each chamber.

3. Apparatus as claimed in claim 2, wherein the gas inlet means feeds the gas into said first chamber adjacent the bottom of said chamber; wherein said wall has an aperture adjacent its top through which the gas passes; and wherein said gas outlet means comprises an outlet port adjacent the bottom of said second chamber.

4. Apparatus as claimed in claim 1, wherein said demoisturising means comprises a tube through which said gas passes, said tube being formed into a helix and mounted with the axis of the helix substantially vertical.

5. Apparatus as claimed in claim 1, wherein said container is mounted within a housing and is electrically insulated therefrom.

6. Apparatus as claimed in claim 5, further comprising reservoir means within said housing; said means to supply water comprising pump means for pumping water from said reservoir means to said water-spraying means; and means interconnecting the container and the reservoir; whereby water from the water-spraying means drains out of said container into said reservoir.

* * * * *